US008152497B2

(12) United States Patent
Gannaway et al.

(10) Patent No.: US 8,152,497 B2
(45) Date of Patent: Apr. 10, 2012

(54) COMPRESSOR

(75) Inventors: Edwin L. Gannaway, Petoskey, MI (US); Clayton Carn, Tecumseh, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 1002 days.

(21) Appl. No.: 11/550,970

(22) Filed: Oct. 19, 2006

(65) Prior Publication Data

US 2007/0140888 A1 Jun. 21, 2007

Related U.S. Application Data

(60) Provisional application No. 60/729,681, filed on Oct. 24, 2005.

(51) Int. Cl.
*F04B 19/02* (2006.01)
*F04B 27/06* (2006.01)

(52) U.S. Cl. ..... 417/460; 417/902; 418/160

(58) Field of Classification Search ..... 417/460, 417/366, 371, 902, 410.3; 418/160
See application file for complete search history.

(56) References Cited

U.S. PATENT DOCUMENTS

| | | | | | |
|---|---|---|---|---|---|
| 779,900 | A | * | 1/1905 | Bartlett | 418/160 |
| 1,240,211 | A | * | 9/1917 | Horvath | 418/160 |
| 1,818,413 | A | | 8/1931 | Luitweiler | |
| 2,103,474 | A | | 12/1937 | Lindberg | |
| 2,135,760 | A | | 11/1938 | Moore | |
| 2,215,873 | A | | 9/1940 | Gahm | |
| 2,237,075 | A | | 4/1941 | Kemper | |
| 2,246,273 | A | * | 6/1941 | Davidson | 418/77 |
| 2,260,867 | A | | 10/1941 | Rappl | |
| 2,313,239 | A | * | 3/1943 | Horton | 417/204 |
| 2,435,108 | A | * | 1/1948 | Touborg | 417/260 |
| 2,689,532 | A | | 9/1954 | Orshansky, Jr. | |
| 3,162,359 | A | | 12/1964 | Becher et al. | |
| 3,251,275 | A | | 5/1966 | Rosenschold et al. | |
| 3,526,942 | A | | 9/1970 | Monden et al. | |
| 3,547,562 | A | | 12/1970 | Cynor | |
| 3,686,687 | A | | 8/1972 | Chavarria et al. | |
| 3,806,284 | A | | 4/1974 | Jacobs | |
| 3,850,551 | A | | 11/1974 | Gamache et al. | |
| 4,132,510 | A | | 1/1979 | Takahashi | |
| 4,584,750 | A | | 4/1986 | Ozu et al. | |
| 4,605,362 | A | | 8/1986 | Sturgeon et al. | |
| 4,842,492 | A | * | 6/1989 | Gannaway | 417/312 |
| 5,173,039 | A | | 12/1992 | Cook | |
| 5,366,355 | A | | 11/1994 | Patterson | |
| 5,800,150 | A | * | 9/1998 | Onoda et al. | 418/63 |
| 6,499,971 | B2 | * | 12/2002 | Narney et al. | 417/410.3 |

OTHER PUBLICATIONS

Canadian Office Action dated Sep. 20, 2011 in corresponding Canadian Application No. 2,565,352.

* cited by examiner

*Primary Examiner* — Devon C Kramer
*Assistant Examiner* — Peter J Bertheaud
(74) *Attorney, Agent, or Firm* — Faegre Baker Daniels LLP

(57) ABSTRACT

In sealed compressors, in one form of the invention, the compressor housing and the compression mechanism are assembled to one another without fasteners. As a result, the time required to install and tighten the fasteners is eliminated, lessen the time required to assemble the compressor. Further, such a fastenerless assembly requires less parts and machining, further reducing the cost of the compressor. Additionally, in one form of the invention, the compression mechanism includes two bearings mounted to the compressor housing and a cylinder block reciprocatingly driven between the bearings by an eccentric member of the crankshaft. Typically, the cylinder block of existing compressors is rigidly mounted to the compressor housing and does not reciprocate.

13 Claims, 11 Drawing Sheets

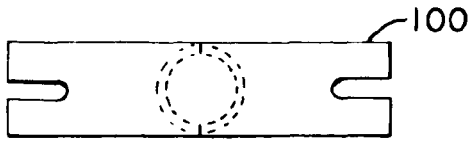
FIG. 7
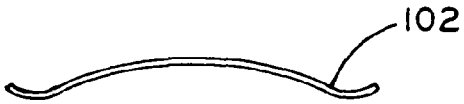
FIG. 8A
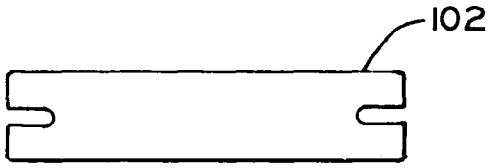
FIG. 8B
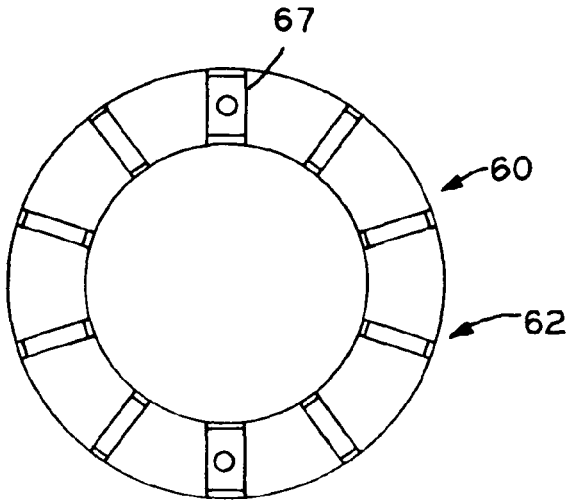
FIG. 9
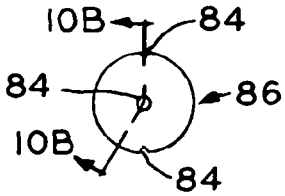
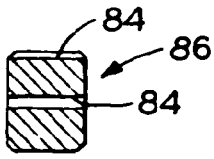
FIG. 10A FIG. 10B

COMPRESSOR

CROSS-REFERENCE TO RELATED APPLICATION

This application claims the benefit under Title 35, U.S.C. §119(e) of U.S. Provisional Patent Application Ser. No. 60/729,681, entitled COMPRESSOR, filed on Oct. 24, 2005.

BACKGROUND OF THE INVENTION

1. Field of the Invention

The present invention relates to compressors and, in particular, compressors for refrigeration systems.

2. Description of the Related Art

Known compressors commonly have a three-part housing including a generally cylindrical main housing and end caps mounted to opposite ends of the main housing. The housing defines an interior space in which a compressor mechanism is mounted. Positive displacement rotary compressor mechanisms commonly include a crankshaft driven by a motor and an eccentric driven by the crankshaft. The eccentric rotates within a cylinder bore of a compressor mechanism cylinder block to compress refrigerant in a refrigeration system. Commonly, the compressor mechanism is fastened to the compressor housing through a plurality of fasteners. Often, a significant amount of time is required to machine and install the fasteners therein. An improvement over the forgoing is discussed below.

SUMMARY OF THE INVENTION

In sealed compressors, in one form of the invention, the compressor housing and the compression mechanism are assembled to one another without fasteners. As a result, the time required to install and tighten the fasteners is eliminated, which lessens the time required to assemble the compressor. Further, such a fastenerless assembly requires fewer parts and machining, further reducing the cost of the compressor. Additionally, in one form of the invention, the compression mechanism includes two bearings mounted to the compressor housing and a cylinder block reciprocatingly driven between the bearings by an eccentric member of the crankshaft. Typically, the cylinder block of existing compressors is rigidly mounted to the compressor housing and does not reciprocate.

In one form of the invention, the compressor includes a cylinder block that is mounted to, and reciprocatingly movable with respect to, a bearing mounted to a compressor housing. In one embodiment, an eccentric is positioned within a cylinder bore of the cylinder block and is driven by a rotating crankshaft. In this embodiment, the cylinder block is mounted to the bearing such that it can translate with respect to the bearing along an axis. The eccentric reciprocatingly drives the cylinder block back and forth along this axis as it rotates within the cylinder bore. In another embodiment, the bearing and a second bearing define a muffler chamber that encompasses the cylinder block. In operation, compressed refrigerant discharged from the cylinder bore of the cylinder block enters the muffler chamber wherein unwanted noise is dampened therein.

In another form of the invention, a bearing is positioned within and, without fasteners, substantially rigidly mounted to a compressor housing. In one embodiment, the peripheral edge of the bearing is positioned within a recess defined by inner surfaces of first and second housing portions. During assembly, in this embodiment, the housing portions are pressed together and welded. The sides of the recess are compressed against the bearing and, as a result, the bearing is firmly contained within the recess and thereby substantially rigidly mounted to the compressor housing.

In one form thereof, the present invention provides a compressor mechanism, including a shaft including an eccentric, a bearing, the shaft rotatably supported by the bearing, and a cylinder block, the cylinder block defining a cylinder bore extending therethrough, the eccentric positioned in the cylinder bore, wherein rotation of the shaft and the eccentric results in reciprocating translation of the cylinder block with respect to the bearing.

In another form thereof, the present invention provides a compressor, including a housing including a first portion and a second portion, a compressor mechanism mounted within the housing, and a bearing compressed between the first second portions of the housing, the compressor mechanism mounted to the bearing, whereby the bearing is mounted to the housing solely by the compression between the first portion and the second portion of the housing.

In another form thereof, the present invention provides a method of assembling a compressor including the steps of mounting a compressor assembly to a bearing, positioning the bearing within a housing having first and second housing portions, and pressing the first and second housing portions against the bearing to mount the bearing within the housing without the need for fasteners.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein:

FIG. 7 is a plan view of the leaf valve of the compressor of FIG. 1;

FIG. 8A is an elevation view of the valve retainer of the compressor of FIG. 1;

FIG. 8B is a plan view of the valve retainer of FIG. 8A;

FIG. 9 is a plan view of the impeller of the compressor of FIG. 1;

FIG. 10A is a plan view of the shaft plug of the compressor of FIG. 1;

FIG. 10B is a cross-sectional view of the shaft plug of FIG. 10A taken along line 10B-10B of FIG. 10A;

Figure 1:
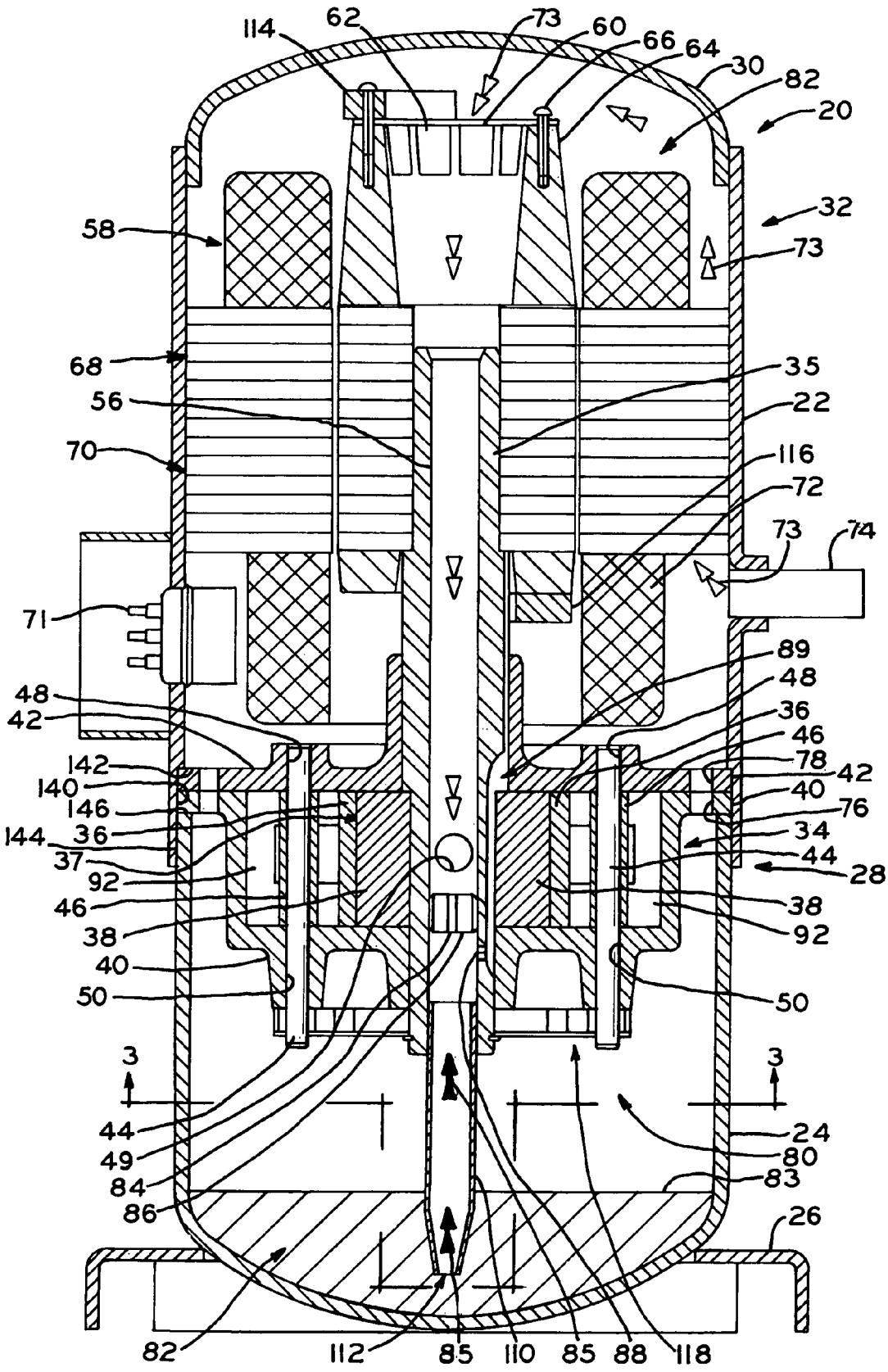
FIG. 1 is a longitudinal cross-sectional view of a single cylinder compressor in accordance with an embodiment of the present invention.

Corresponding reference characters indicate corresponding parts throughout the several views. Although the drawings represent exemplary embodiments of the present invention, the drawings are not necessarily to scale and certain features may be exaggerated to better illustrate and explain the present invention. The exemplifications set out herein illustrate exemplary embodiments of the invention and such exemplifications are not to be construed as limiting the scope of the invention in any manner.

DETAILED DESCRIPTION

Referring to FIG. 1, single-cylinder compressor 20 is shown which includes cylindrical main housing 22, bottom cap 24 secured to a lower end 28 of housing 22, and top cap 30 secured to an upper end 32 of housing 22, each by a welding, brazing, or other suitable operation to thereby define an enclosed hermetic housing in which compressor mechanism 34 of compressor 20 is disposed. Compressor 20, in this embodiment, is a vertical compressor and includes base 26 secured to bottom cap 24 to support the compressor in an upright position.

Figure 3:
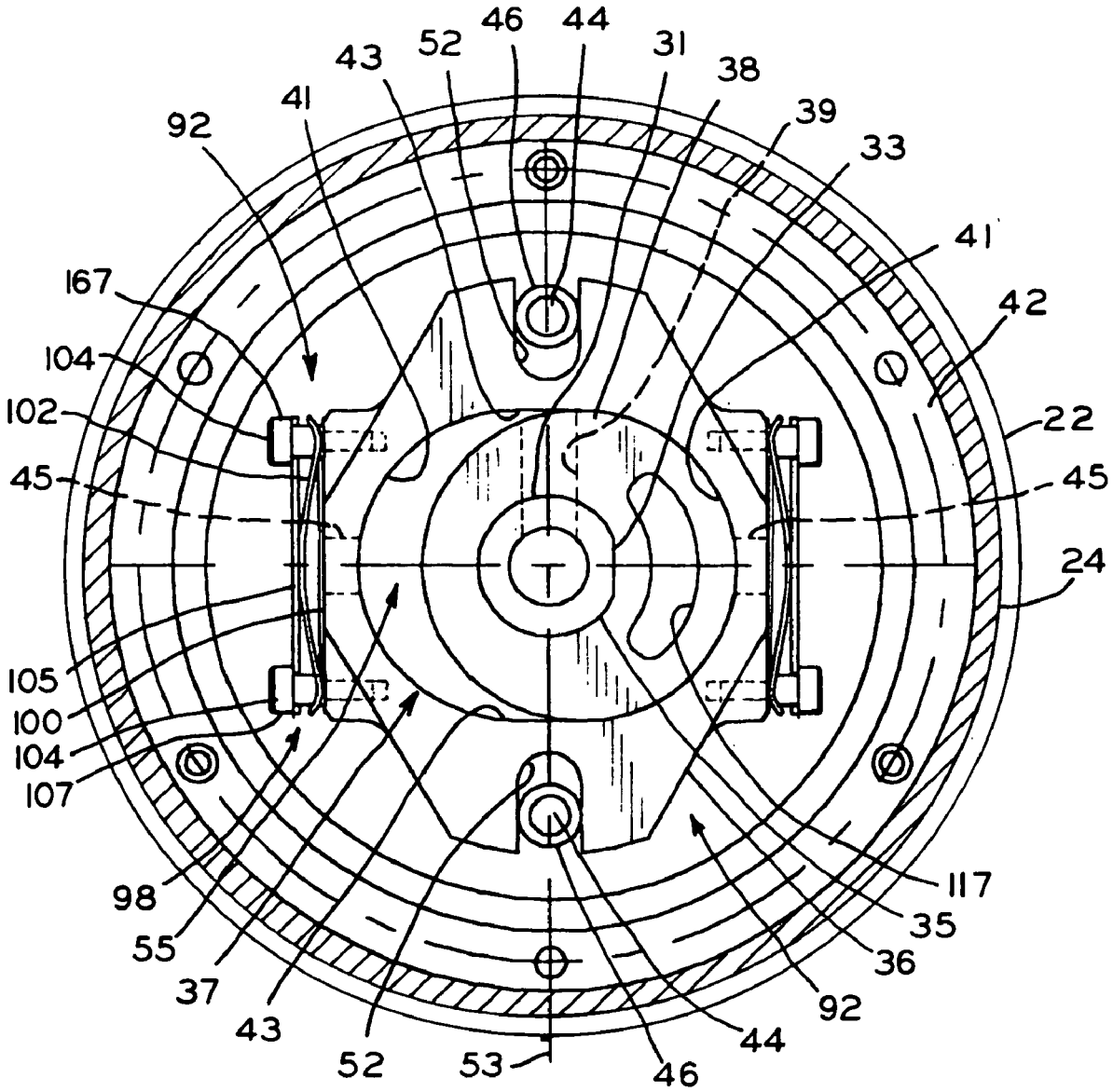
FIG. 3 is a transverse cross-sectional view of the compressor of FIG. 1 taken along line 3-3 of FIG. 1 with parts of the compressor removed.
Figure 4:
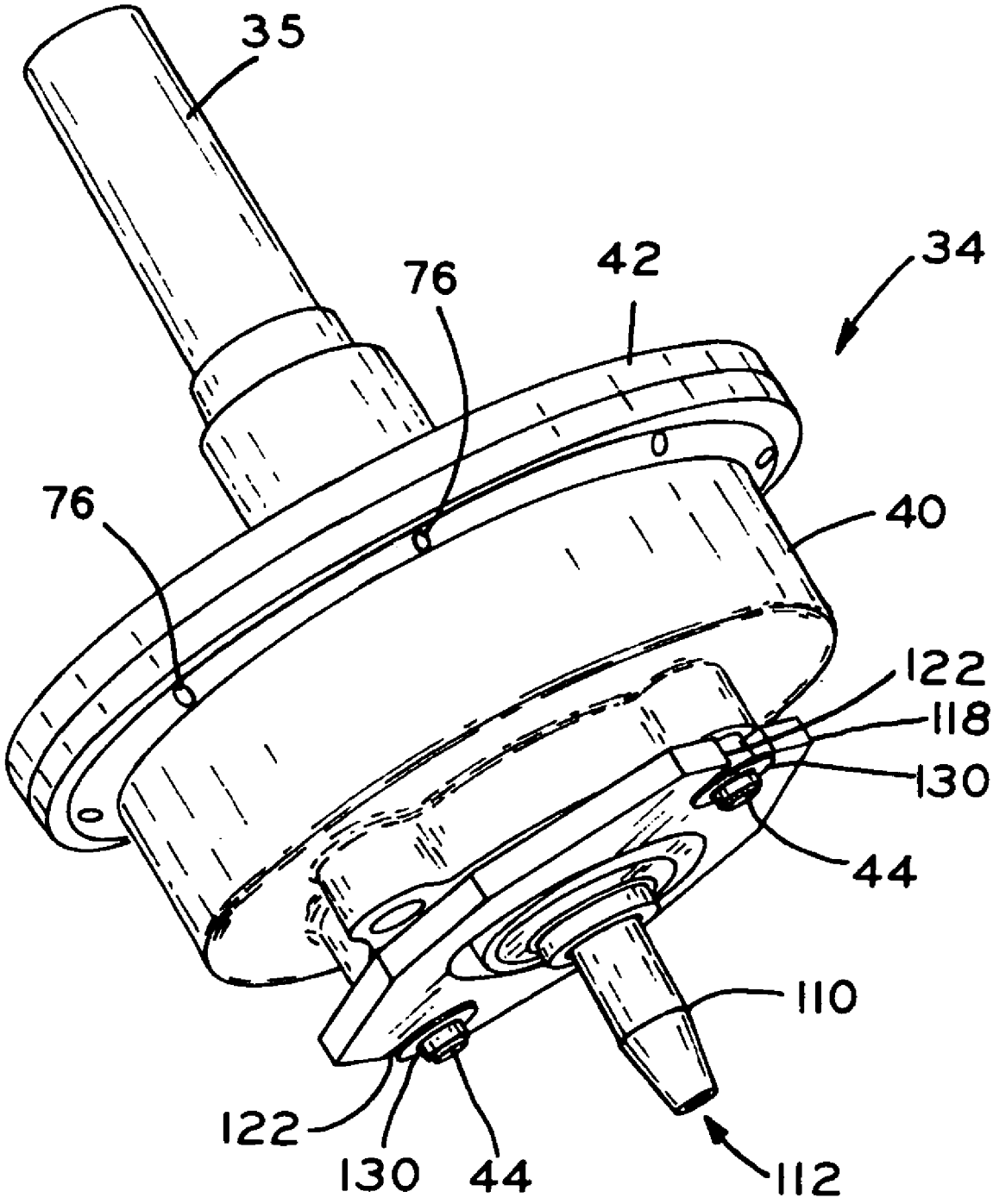
FIG. 4 is a perspective view of the compressor mechanism assembly of FIG. 1.

Compressor mechanism 34 includes shaft 35, reciprocating cylinder block 36, eccentric 38 operatively engaged with shaft 35 and positioned within cylinder bore 37 of cylinder block 36, lower bearing 40 and upper bearing 42. In one exemplary embodiment, cylinder block 36 is mounted between and substantially surrounded by lower bearing 40 and upper bearing 42. As illustrated in FIG. 3, eccentric 38 includes aperture 39. Aperture 39 includes substantially cylindrical portion 31 and substantially flat portion 33 which are tightly interfitted with similar, corresponding geometries on shaft 35. Due to corresponding and operatively engaged flat portions, shaft 35 and eccentric 38 are keyed together and the rotational motion of shaft 35 is transmitted to eccentric 38 during operation of the compressor.

In operation, shaft 35 is rotated by electric motor 68. Electric motor 68 includes rotor 64 affixed to shaft 35 and is positioned within stator 70. Windings 72 of stator 70, when energized by an electric source, create a rotating magnetic field which turns rotor 64. In the present embodiment, windings 72 are energized from an outside electrical source through electrical connector 71. Stator 70 includes outer substantially flat surfaces (not shown) which allow refrigerant to pass from suction inlet 74 in housing 22 through gaps (not shown) between the substantially flat sides of stator 70 and housing 22.

As illustrated in FIGS. 1 and 3, compressor mechanism 34 further includes guide members, such as dowels 44, and bearing rollers 46. Dowels 44 extend through, and are tightly interfitted with, apertures 48 of upper bearing 42 and apertures 50 of lower bearing 40 such that dowels 44 hold bearings 40 and 42 together prior to their placement into the compressor housing. Bearing rollers 46 may be substantially concentrically interfitted over dowels 44 and positioned between upper bearing 42 and lower bearing 40. Bearing rollers 46, along with dowels 44, are positioned within guide recesses 52 (FIG. 3) of cylinder block 36, which define the relative reciprocal movement of cylinder block 36 with respect to bearings 40 and 42, as discussed in detail further below. Guide recesses 52 may be subtantially linear, although other configurations may also be utilized.

Referring to FIGS. 1, 3, and 14A-14D, eccentric 38 is positioned within cylinder bore 37 and constantly engages a portion thereof. Eccentric 38 can directly or indirectly engage cylinder bore 37, e.g, by way of a bushing, roller, et cetera between eccentric 38 and cylinder bore 37. Eccentric 38, in this embodiment, is substantially circular but is eccentrically positioned on shaft 35. Cylinder bore 37, in this embodiment, includes two substantially semicircular wall portions 41 and substantially straight walls 43. Substantially straight walls 43 are substantially parallel to each other and define a dimension therebetween that is approximately the same size as, but slightly larger than, the diameter of circular eccentric 38. In another way, at any rotational position of eccentric 38 within cylinder bore 37, eccentric 38 is in sealing contact with straight walls 43. Semicircular portions 41 each define a diameter that is the same size or slightly larger than the diameter of eccentric 38 and substantially equal to the above-mentioned dimension between side walls 43. The centers of semicircular portions 41 are substantially co-linear with the mid-line between walls 43 wherein portions 41 and 43 define, essentially, an elongate cavity having rounded ends.

As eccentric 38 is rotated by shaft 35, eccentric 38 will typically bear against one of walls 43 of cylinder block 36 and reciprocatingly translate cylinder block 36 along axis 53 (FIG. 14A) defined by guide recesses 52. More specifically, when eccentric 38 is in the position illustrated in FIG. 14B, cylinder block 36 has been translated along axis 53 from its centered position illustrated in FIG. 14A to accommodate the eccentricity of eccentric 38. When eccentric 38 is in the position illustrated in FIG. 14C, cylinder block 36 has been driven back to a centered position as roller 38 is no longer eccentric with respect to the axis. When eccentric 38 is in the position illustrated in FIG. 14D, eccentric 38 has translated cylinder block 36 in the opposite direction along axis 53 to, once again, accommodate the eccentricity of eccentric 38. The positions of eccentric 38 illustrated in FIGS. 14A-14D occur once during each revolution of shaft 35. In operation, eccentric 38 continuously cycles through these positions.

Figure 14A:
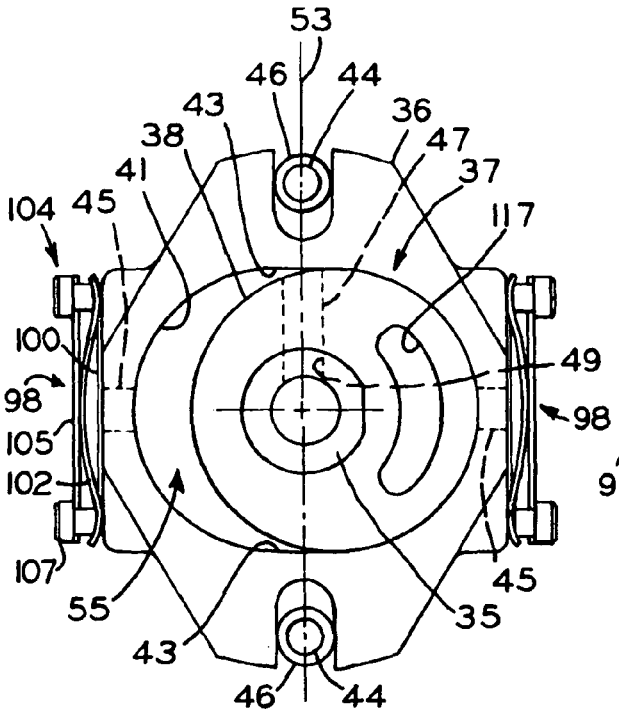
FIG. 14A is an end view of the compressor mechanism of FIG. 1 with parts removed illustrating the eccentric in its top-dead-center (TDC) position.

Eccentric 38 further includes suction port 47, illustrated in phantom in FIGS. 3 and 14A-14D, in fluid communication with suction port 49 in shaft 35 (FIG. 1). Cylinder block 36 includes two discharge ports 45, also illustrated in phantom, located on opposite sides of cylinder bore 37. In operation, when eccentric 38 is in its top-dead-center (TDC) position, as illustrated in FIG. 14A, chamber 55 is defined by eccentric 38, upper bearing 42, lower bearing 40 and one of semicircular portions 41 of cylinder block 36. In this position, chamber 55 (FIG. 14A) is in fluid communication with one of discharge ports 45, as illustrated in FIG. 14A. Also, in this position, compression chamber 55 is in fluid communication with suction port 47 of roller 38. In operation, refrigerant in the interior plenum of housing 20 flows through suction port 49 of shaft 35 and suction port 47 of roller 38 into chamber 55.

Figure 14B:
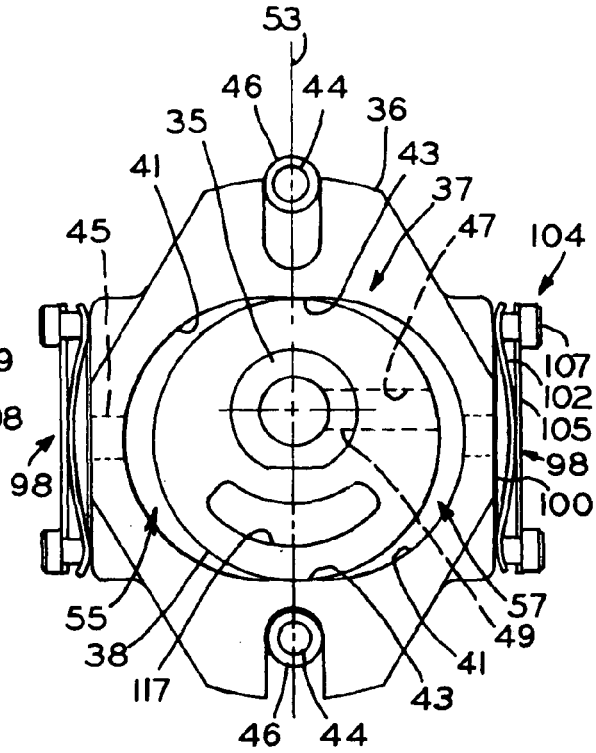
FIG. 14B is an end view of the compressor mechanism of FIG. 14A illustrating the eccentric rotated 90 degrees from its TDC position.
Figure 14C:
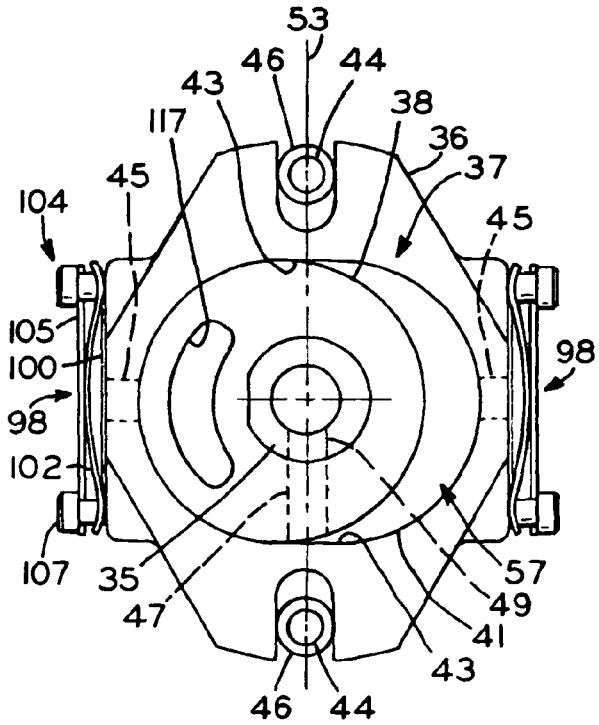
FIG. 14C is an end view of the compressor mechanism of FIG. 14A illustrating the eccentric in its bottom-dead-center (BDC) position.
Figure 14D:
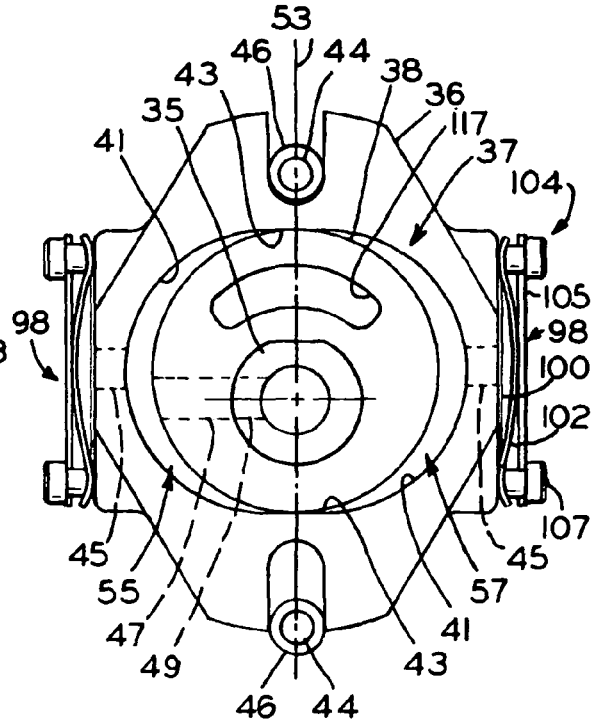
FIG. 14D is an end view of the compressor mechanism of FIG. 14A illustrating the eccentric rotated 90 degrees from its BDC position.

When eccentric 38 is in the position illustrated in FIG. 14B, a second compression chamber, chamber 57, is defined by eccentric 38, upper bearing 42, lower bearing 40 and the other semicircular portion 41 of cylinder block 36. In the position illustrated in FIG. 14B, chambers 55 and 57 are substantially the same size. In this position, suction port 47 is in fluid communication with second chamber 57 wherein chamber 57 represents the suction chamber. As eccentric 38 continues to rotate, the size of chamber 55 continues to decrease and the size of chamber 57 continues to increase. Correspondingly, the pressure of the refrigerant contained in chamber 55 increases until it reaches a level sufficient to resiliently lift the discharge valve covering the discharge port 45 in fluid communication with chamber 55 away from its valve seat, as discussed in further detail below. As eccentric 38 continues to rotate, chamber 55 decreases in size until eccentric 38 is substantially enveloped by portion 41, as illustrated in FIG. 14C. In this position, suction inlet 47 is still in fluid communication with second chamber 57 wherein chamber 57 still represents the suction chamber. However, as eccentric 38 continues to rotate past the position illustrated in FIG. 14C, suction port 47 is placed out of fluid communication with second chamber 57 and is placed into fluid communication with first chamber 55. As a result, first chamber 55 is, once again, the suction chamber and second chamber 57 is, once again, the discharge chamber. Accordingly, as eccentric 38 moves into the position illustrated in FIG. 14D, chamber 55 increases in size drawing refrigerant therein and chamber 57 decreases in size compressing the refrigerant contained therein. When eccentric 38 is in the position represented by FIG. 14D, chambers 55 and 57 are substantially the same size, similar to the position illustrated in FIG. 14B. As eccentric 38 rotates from the position illustrated in FIG. 14D to the position illustrated in FIG. 14A, second chamber 57 decreases in size compressing the refrigerant contained therein until the discharge valve covering the discharge port 45 in fluid communication with chamber 57 lifts away from its valve seat allowing compressed refrigerant to escape therethrough.

In another way of describing the above, the first chamber serves as the suction chamber for approximately 180° of revolution of eccentric 38 and as the compression chamber for the remaining approximately 180° of eccentric 38. Correspondingly, the second chamber serves as the compression chamber for approximately 180° of revolution of eccentric 38 and as the suction chamber for the remaining approximately 180° of eccentric 38.

In operation, refrigerant, represented by arrows 73 (FIG. 1), is drawn into the suction chamber through aperture 49 (FIGS. 14A-14D) in shaft 35. Aperture 49 is in fluid communication with elongate aperture 56 extending along the axis of shaft 35 which is in fluid communication with interior plenum 58 of compressor 20. Refrigerant in gaseous form enters into elongate aperture 56 through impeller 60 (FIGS. 1 and 9). However, refrigerant in liquid form which enters into impeller 60 is centrifuged, or accelerated outwardly, and is substantially prevented from entering into aperture 56. Impeller 60 is mounted to shaft 35 and includes fan blades 62, which inhibit liquid refrigerant from entering into aperture 56. In this embodiment, impeller 60 is mounted to rotor 64 with bolts 66 passing through bolt holes 67.

Figure 2:
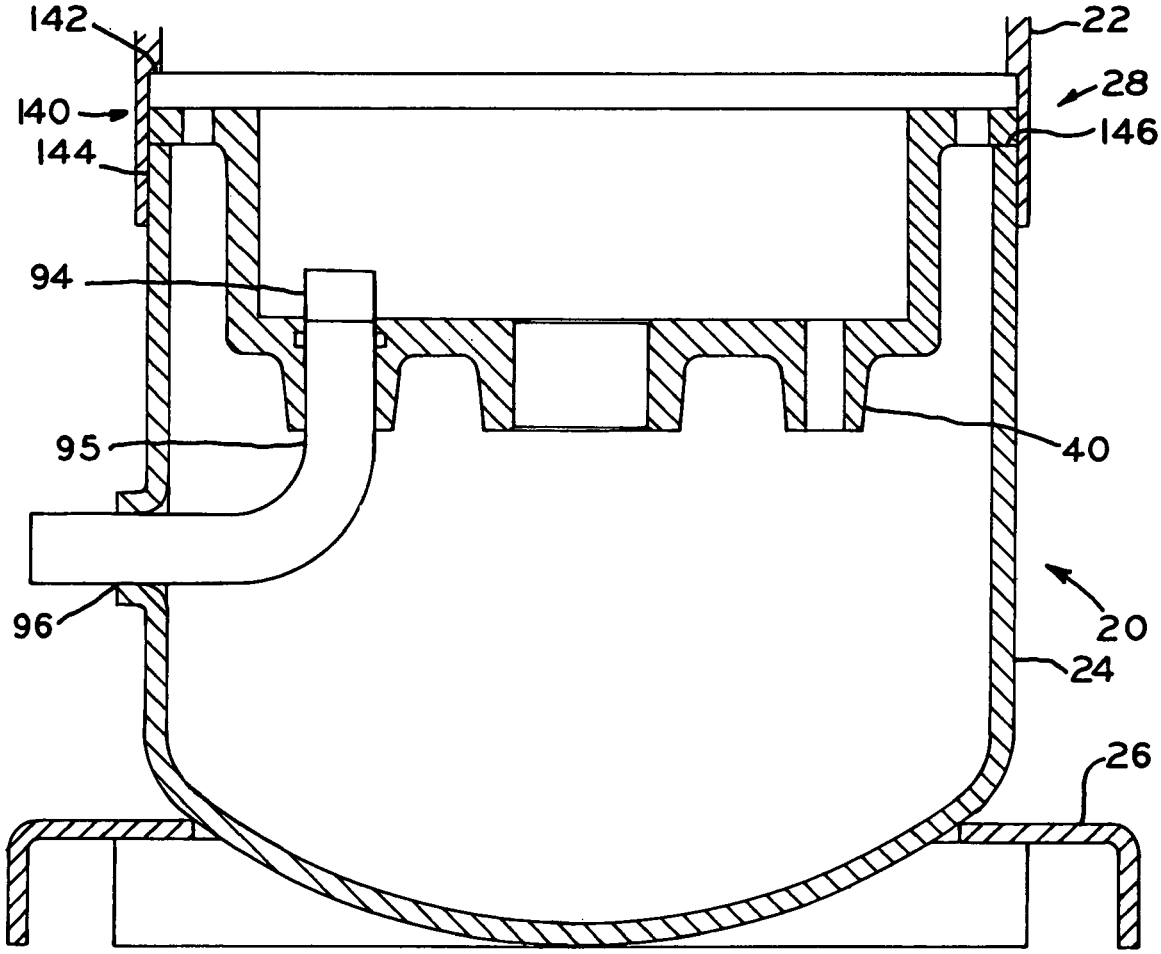
FIG. 2 is a cross-sectional, partial view of the compressor of FIG. 1 with parts of the compressor removed.

As illustrated in FIGS. 1 and 2, upper bearing 42 and lower bearing 40 are captured between housing 22 and bottom cap 24. In this embodiment, bearings 40 and 42 are compressed between housing 22 and bottom cap 24. Specifically, housing 22 includes recess 140 formed therein and defining shoulder 142. Shoulder 142 is positioned adjacent upper bearing 42 to substantially entirely contact upper bearing 42. Wall portion 144 of housing 22 defines a portion of recess 140 and is configured to engage the outer surface of bottom cap 24. Additionally, end surface 146 of bottom cap 24 contacts the bottom of lower bearing 40, pressing it into upper bearing 42. In this configuration, housing 22 presses upper bearing 42 and lower bearing 40 against end surface 146 of bottom cap 24. As a result, bearings 40 and 42 are fixed relative to the compressor without the use of fasteners. Such an arrangement reduces the cost of the compressor and decreases the assembly time of the compressor.

To further secure housing 22 and bottom cap 24 in position, housing 22 and bottom cap 24 may be welded, braised, or connected in another suitable fashion to hold their relative positions therebetween. In one exemplary embodiment, housing 22 and bottom cap 24 are secured together by welding. During the welding process, housing 22 and bottom cap 24 are heated, causing expansion of housing 22 and bottom cap 24. When housing 22 and bottom cap 24 are securely welded to one another in this expanded condition, the subsequent cooling of housing 22 and bottom cap 24 results in contraction of housing 22 and bottom cap 24. This contraction presses shoulder 142 of housing 22 toward upper bearing 42 and also presses end surface 146 of bottom end 24 toward lower bearing 40, pressing bearings 40, 42 together. In another exemplary embodiment, brazing is used instead of welding to achieve the results described in detail above. As illustrated in FIG. 1, lower bearings 40 includes apertures 76 and upper bearing 42 includes apertures 78 to promote fluid communication between lower interior plenum 80 and upper interior plenum 82.

As illustrated in FIG. 1, oil reservoir 83 is located in the bottom of compressor 20. Oil reservoir 83 includes oil that precipitates from refrigerant as it passes into the compressor housing through suction port 74. As illustrated in FIG. 1, shaft 35 includes oil impeller 110 affixed thereto. Oil impeller 110 includes an opening 112 which is typically submerged in oil reservoir 83. As shaft 35 is rotated, oil from oil reservoir 83, represented by arrows 85, is drawn into impeller 110 until it reaches aperture 88 in shaft 35. Thereafter, the oil flows through aperture 88 into oil channel 89 to lubricate the interface between the bearings 40 and 42 and shaft 35. Referring to FIG. 1, oil plug 86 is positioned in shaft 35 to substantially prevent the oil in reservoir 83 from being sucked into suction inlet 49. However, oil plug 86 includes apertures 84 (FIGS. 1, 10A and 10B) which allow some oil to flow from reservoir 83 into suction inlet 49 to lubricate the moving compressor components.

Figure 5:
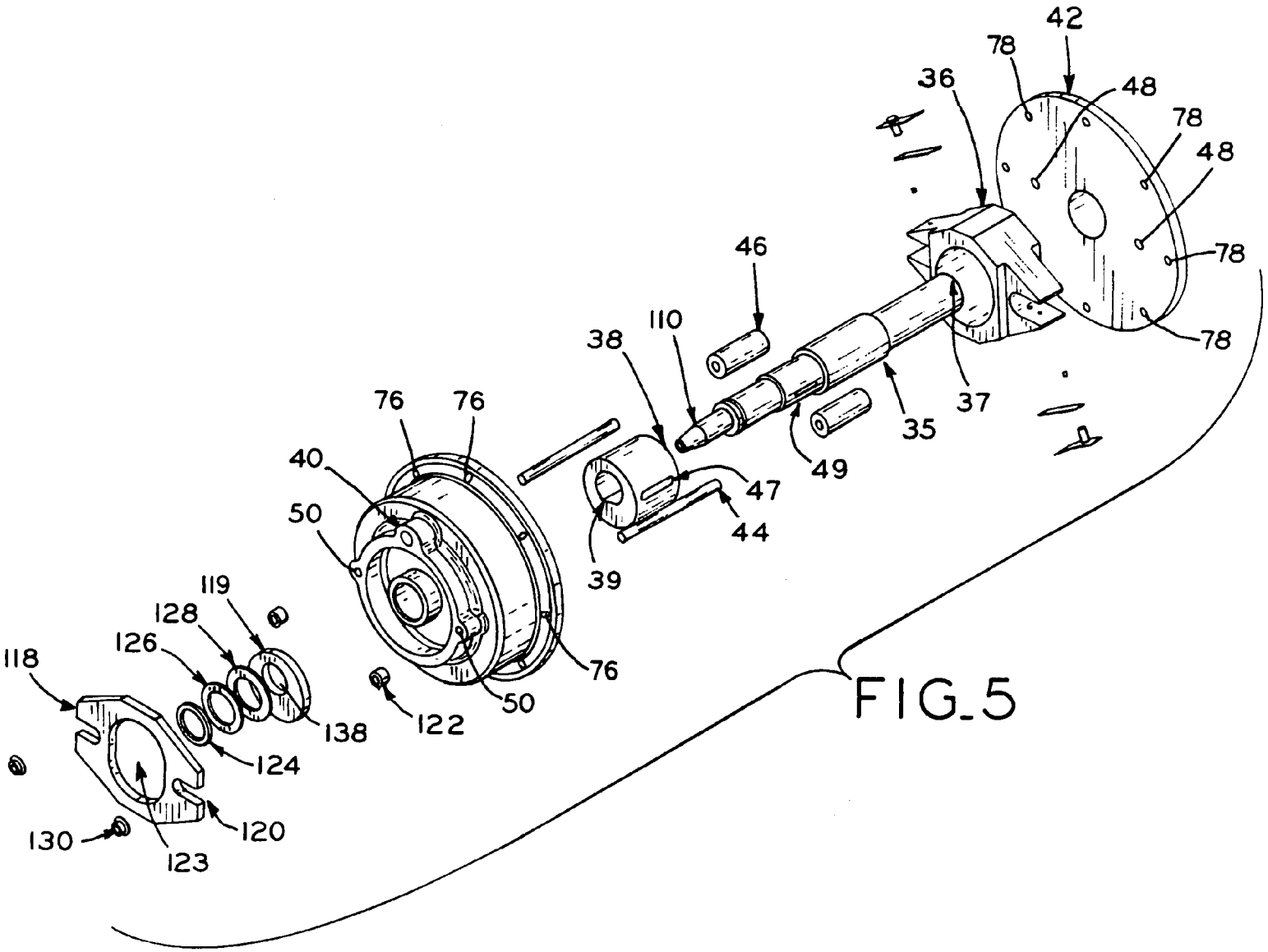
FIG. 5 is an exploded view of the compressor mechanism assembly of FIG. 1.

As mentioned above, when eccentric 38 is rotated by shaft 35, cylinder block 36 is reciprocatingly driven along an axis defined by rollers 46 and dowels 44. The compression chamber between eccentric 38 and cylinder block 36 is in fluid communication with discharge port 45. Discharge port 45 is in fluid communication with muffler region 92 which is defined by lower bearing 40 and upper bearing 42. Muffler region 92 defines a volume of space that dampens the acoustic energy of the refrigerant after it has been compressed. Muffler region 92 is in fluid communication with discharge port 94 (FIG. 2) in lower bearing 40. As illustrated in FIG. 2, discharge port 94 is in fluid communication with discharge tube 95 which extends through aperture 96 in lower cap 24. Discharge tube 95 is welded or braised to lower cap 24 to sealingly engage them together. Refrigerant flowing through discharge tube 95 enters the refrigeration system thereafter. As illustrated in FIG. 3, valve assembly 98 covers the discharge port of cylinder block 36. Discharge valve assembly 98 includes discharge valve 100, valve stop 102, and retainer 105 which are mounted to cylinder block 36 through shoulder bolts 104, as illustrated in FIGS. 3, 7, 8A and 8B. Discharge valve 100, valve stop 102 and retainer 105 include elongate bodies having elongate recesses at the ends thereof through which shoulder bolts 104 pass therethrough. As illustrated in FIG. 8A, valve stop 102 is arcuate along its length and provides support for discharge valve 100 when it deflects away from the discharge port of cylinder block 36. Retainer 105, which bear against heads 107 of shoulder bolts 104, provides support for valve stop 102 by preventing substantial translation thereof. Discharge valve 100 covers the discharge port of cylinder block 36 until sufficient pressure has been developed in the discharge chamber, thereafter, the leaf valve is flexed away from the discharge port by the compressed refrigerant, as is well known in the art. After sufficient refrigerant has escaped from the discharge chamber, the force applied to the leaf spring will reduce and the leaf spring will return to cover the discharge port of cylinder block 36. This process is repeated throughout operation of the compressor. A cantilevered leaf valve and valve support are illustrated in FIG. 5.

To balance the rotating components of the compressor, counterweights may be attached thereto. As illustrated in FIG. 1, counterweight 114 is affixed to impeller 60 through bolts 66. Also, counterweight 116 is affixed to the lower end of rotor 64 to balance the rotating weight of the rotor. In addition to adding weights, material can be removed from rotating components to facilitate counterbalancing. For example, as illustrated in FIGS. 3 and 14A-14D, material has been removed from eccentric 38 to create aperture 117. To counterbalance reciprocating cylinder block 36 of the present single-cylinder compressor, as illustrated in FIGS. 1, 4, 5 and 6, plate 118 is operatively engaged with shaft 35 such that plate 118 reciprocates substantially 180° out-of-phase with cylinder block 36. Plate 118 includes elongate recesses 120 (FIG. 5) for operatively engaging rollers 122 and moves in a manner similar to cylinder block 36 as discussed above. Rollers 122, like rollers 46, are positioned over dowels 44 to facilitate relative movement between plate 118 and lower bearing 40 as plate 118 is translated along axis 136, which is defined by rollers 122 and dowels 44. Plate 118 is driven by eccentric 119 mounted to shaft 35 which rotates within aperture 123 of plate 118.

Figure 6:
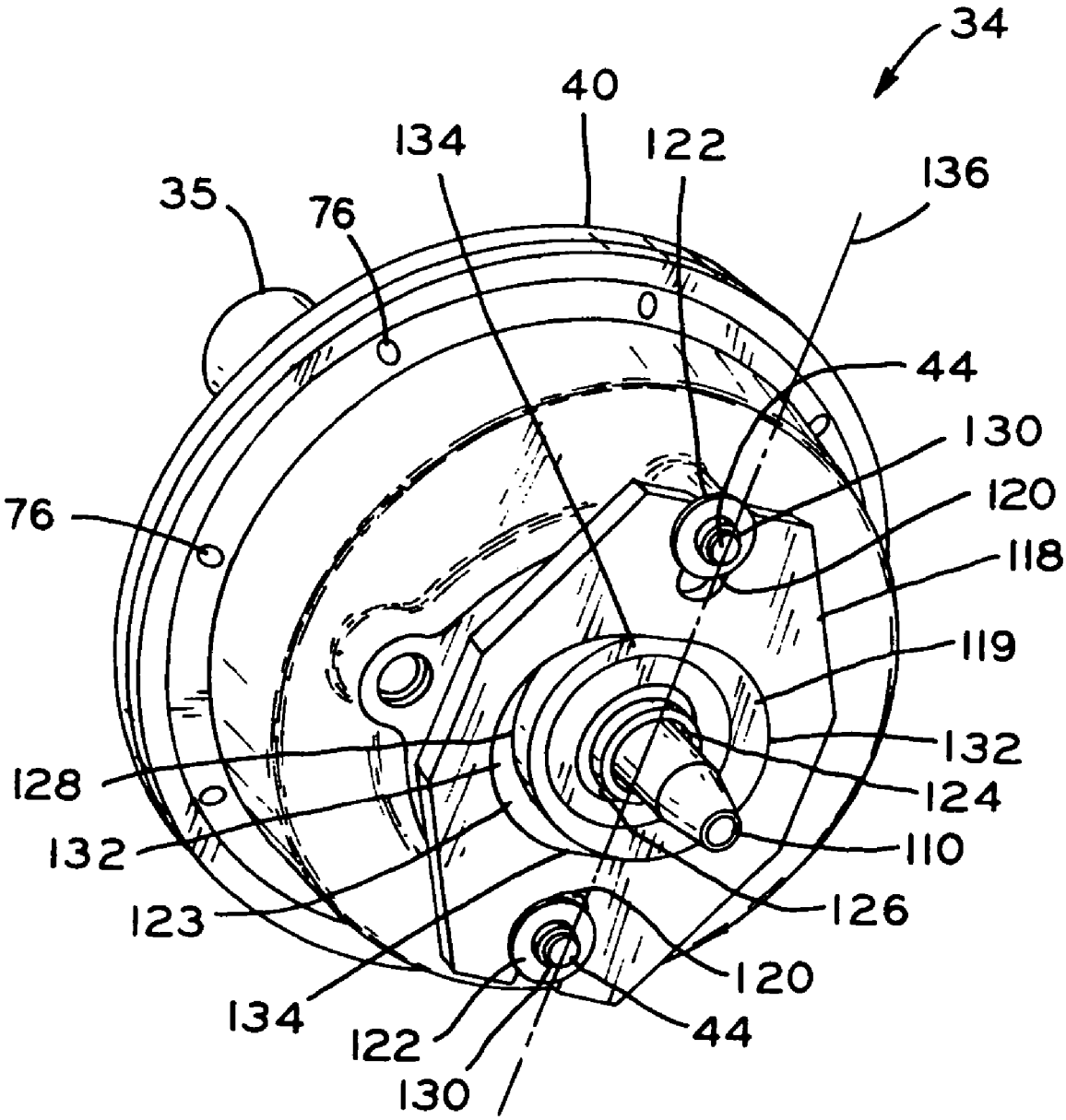
FIG. 6 is a second perspective view of the compressor mechanism assembly of FIG. 1.

Similar to cylinder bore 37, aperture 123, referring to FIG. 6, includes two substantially semicircular portions 132 and two substantially straight walls 134. Similar to eccentric 38 and cylinder 37, aperture 123 and second eccentric 119 are constructed such that second eccentric 119 contacts substantially straight walls 134, in an alternating manner, to drive plate 118 along axis 136. Referring to FIGS. 5 and 6, the position of second eccentric 119 on shaft 35 is maintained by retaining ring 124 which engages shaft 35, retaining washer 126 and spring washer 128 which is elastically compressed between lower bearing 40 and retaining washer 126. As illustrated in FIG. 5, second eccentric 119 includes aperture 138. Aperture 138 (FIG. 5) includes a substantially cylindrical portion and a substantially flat portion which are tightly interfitted with similar, corresponding geometries on shaft 35. Due to corresponding and operatively engaged flat portions, shaft 35 and second eccentric 119 are keyed together and the rotational motion of shaft 35 is transmitted to second eccentric 119 during operation of the compressor. Referring to FIG. 6, the position of plate 118 between rollers 122 is maintained by nuts 130 mounted on the ends of dowels 44 to maintain plate 118 against or substantially adjacent to lower bearing 40. In one embodiment, nuts 130, which each include an elastic spring member, are snapped onto dowels 44. In this embodiment, the spring members of nuts 130 can provide a resilient spring force against plate 118.

In one embodiment, it is desirable for plate 118 and cylinder block 36 to weigh substantially the same amount, thereby substantially balancing the forces created by plate 118 and roller 38 as they travel in opposite directions. In another way, the mass of plate 118, when accelerated along axis 136, generates a force along axis 136. Similarly, the mass of cylinder block 36, when accelerated along axis 53, also generates a force. However, as plate 118 and cylinder block are moving 180° degrees out-of-phase with each other, i.e., they are traveling in opposite directions at substantially the same speed, the forces created by their accelerating masses substantially cancel each other out. As a result, very little vibration results from the accelerating masses of plate 118 and cylinder block 36. In one embodiment, cylinder block 36 is constructed from aluminum and plate 118 is constructed from steel. As steel is heavier than aluminum, plate 118 is smaller than cylinder block 36, yet they are substantially the same weight. Such an embodiment is illustrated in FIGS. 1, 4, 5 and 6.

Figure 11:
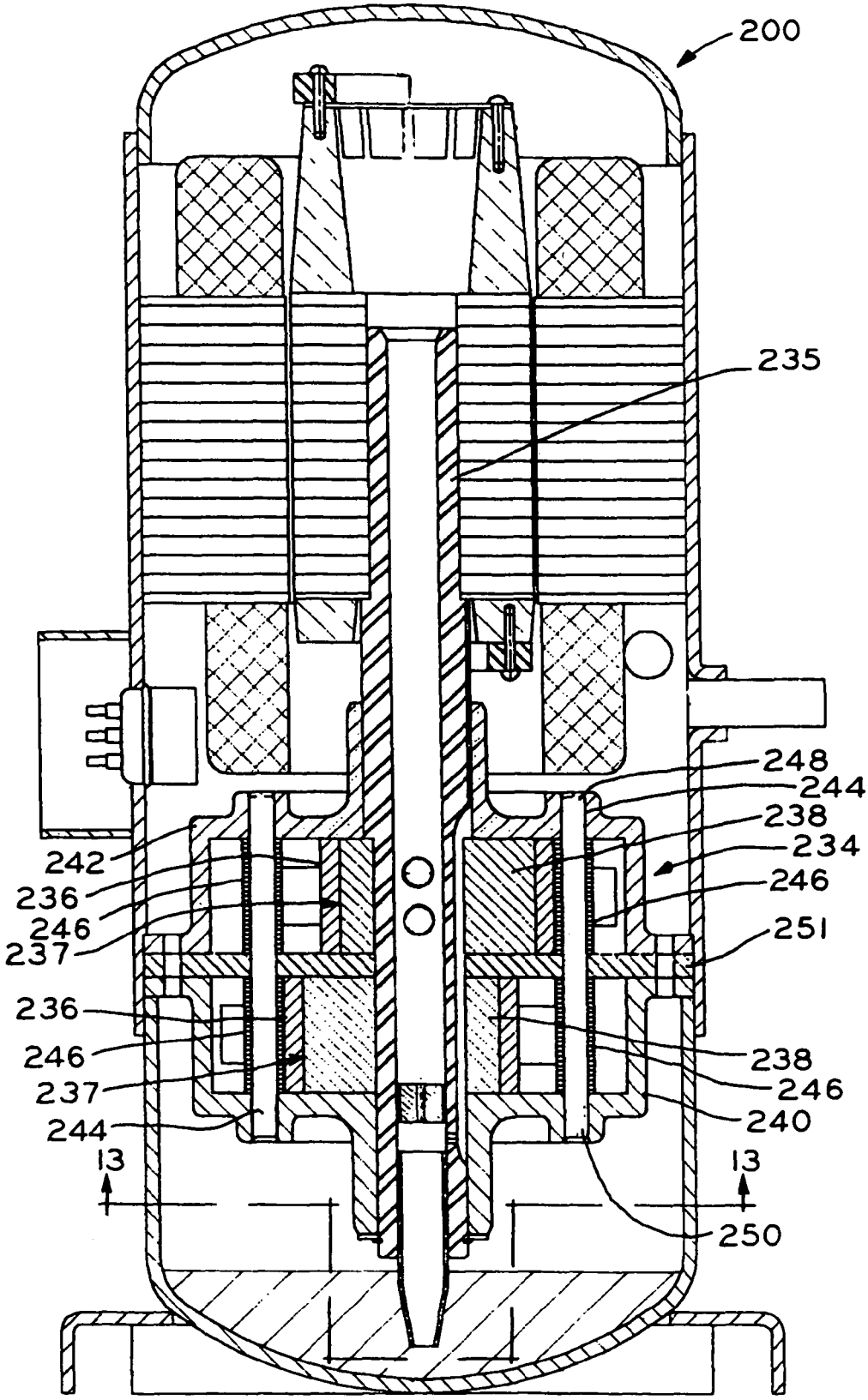
FIG. 11 is a longitudinal cross-sectional view of a twin-cylinder compressor in accordance with an embodiment of the present invention.
Figure 12:
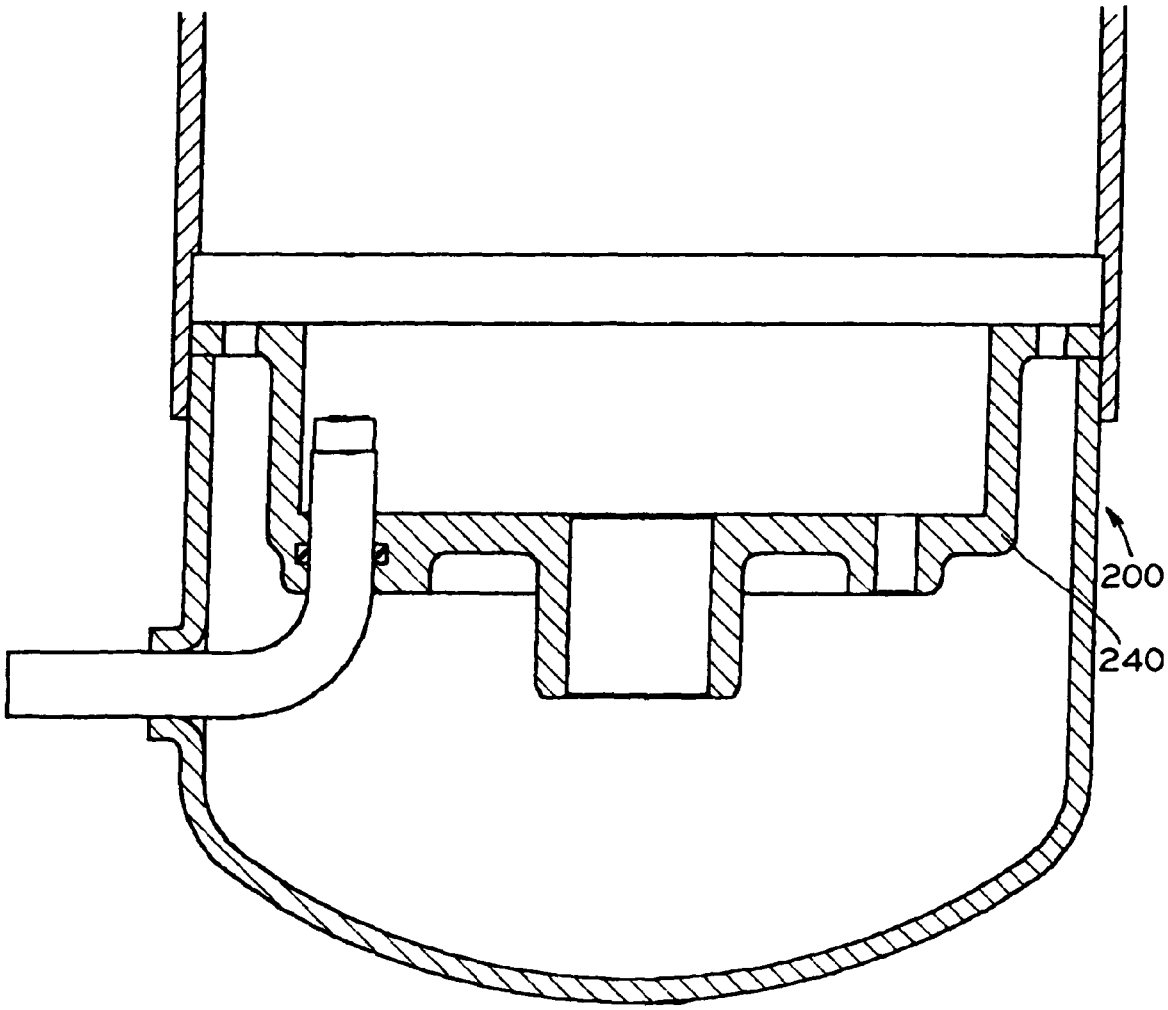
FIG. 12 is a cross-sectional, partial view of the twin-cylinder compressor of FIG. 11 with parts of the compressor removed.
Figure 13:
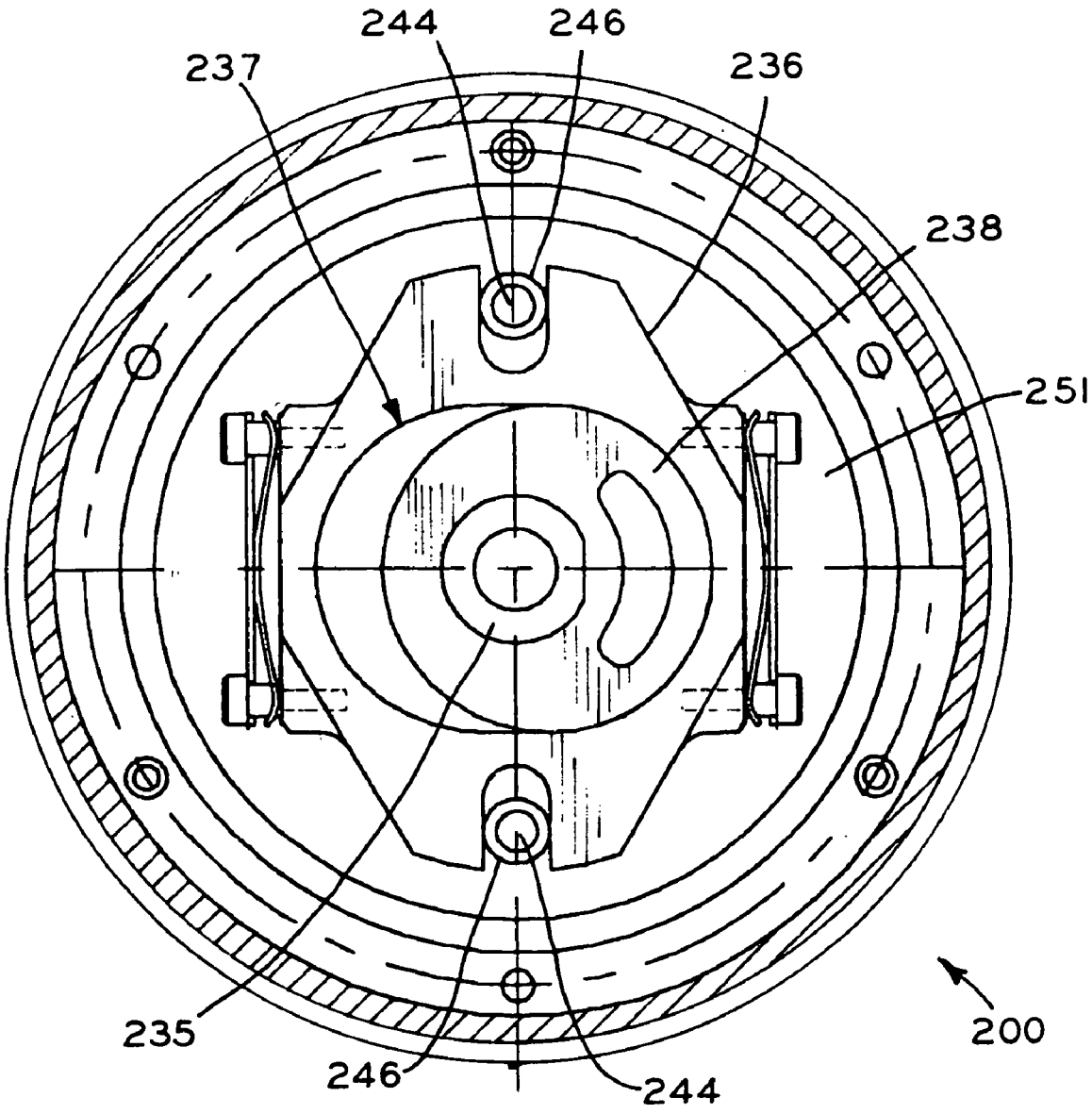
FIG. 13 is a transverse cross-sectional view of the compressor of FIG. 11 taken along line 13-13 of FIG. 11 with parts of the compressor removed.

In embodiments having two cylinders 180° degrees out of phase with each other, such as the embodiment illustrated in FIGS. 11-13, the cylinder blocks substantially counterbalance each other and plate 118 may be unnecessary. Generally, compressor 200, depicted in FIGS. 11-13, operates, substantially, in accordance with the description for compressor 20, however, some of the differences are described below. Compressor 200 includes compressor mechanism 234 which includes shaft 235, two cylinder blocks 236, two eccentrics 238 operatively engaged with shaft 235 and positioned within cylinder bores 237 of cylinder blocks 236, lower bearing 240 and upper bearing 242. Compressor mechanism 234 further includes dowels 244 and four bearing rollers 246. Similar to the above, dowels 244 extend through, and are tightly interfitted with, apertures 248 of upper bearing 242 and apertures 250 of lower bearing 240 such that dowels 244 hold bearings 240 and 242 together prior to their placement into the compressor housing. Bearing rollers 246 are substantially concentrically interfitted over dowels 244 and are positioned between upper bearing 242 and center plate 252 and lower bearing 240 and center plate 252. Center plate 252, along with bearings 240 and 242, separately enclose the compression and discharge chambers within cylinder bores 237. Further, center plate 252, along with bearings 240 and 242, can separately enclose the chambers surrounding cylinder blocks 236 thereby creating two muffler chambers. These muffler chambers operate in a similar manner as the single-cylinder embodiment. In some embodiments, these muffler chambers are in fluid communication. Other embodiments in accordance with the present invention having more than two cylinders are envisioned.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor, comprising:

a hermetic housing having a refrigerant inlet and a refrigerant outlet;

a motor having a stator and a rotor positioned within said housing;

a crankshaft including an eccentric, said crankshaft rotatably engaged with said rotor;

first and second bearings positioned within said housing, said crankshaft rotatably supported by at least one of said bearings; and a cylinder block moveable relative to said bearings, said cylinder block defining with said eccentric at least one compression chamber configured to receive a refrigerant therein, said eccentric positioned in and engaging said cylinder block whereby rotation of said crankshaft and said eccentric causes reciprocating translation of said cylinder block with respect to said bearings and relative movement between at least one inner wall of said compression chamber and said eccentric to compress the refrigerant in said compression chamber from a suction pressure to a discharge pressure;

said hermetic housing comprising a first portion and a second portion connected to said first portion, said first and second bearings being disposed between said first and second portions of said hermetic housing and pressed together by said first and second portions of said hermetic housing;

wherein said cylinder block is spaced radially inwardly from said hermetic housing and said bearings radially enclose said cylinder block and contact said cylinder block on opposite axial ends thereof to form said at least one compression chamber.

2. The compressor of claim 1, wherein at least one of said bearings comprises a guide member and said cylinder block comprises a guide recess, said guide member positioned in said guide recess, said guide recess defining relative reciprocating translation of said cylinder block with respect to said at least one bearing.

3. The compressor of claim 2, wherein said guide recess is substantially linear and defines an axis, whereby the relative reciprocating translation of said cylinder block with respect to said at least one bearing is parallel to said axis.

4. The compressor of claim 2, wherein said at least one bearing further comprises a second guide member and said cylinder block further comprises a second guide recess, said second guide member positioned within said second recess, said first and second guide members defining an axis, whereby the relative reciprocating translation of said cylinder block with respect to said at least one bearing is parallel to said axis.

5. The compressor of claim 1, wherein said eccentric constantly bears against at least a portion of said cylinder block defining said cylinder bore, whereby rotation of said eccentric compresses fluid within said compression chamber.

6. The compressor of claim 5, wherein the portion of said cylinder block defining said cylinder bore comprises opposing substantially semicircular wall portions and substantially straight walls positioned between said opposing substantially semicircular wall portions, wherein said eccentric is in sealing contact with said substantially straight walls at any rotational position of said eccentric.

7. The compressor of claim 1, wherein said bearings and said cylinder block form an assembly, and including a guide member on said assembly slidably interfitted with a guide recess on said assembly to define relative reciprocation of said cylinder block with respect to said bearings.

8. A compressor, comprising:

a hermetic housing having a refrigerant inlet and refrigerant outlet;

a motor having a stator and a rotor positioned within said housing;

a crankshaft including an eccentric, said crankshaft rotatably engaged with said rotor;

a bearing positioned within said housing, said crankshaft rotatably supported by said bearing; and a cylinder block moveable relative to said bearing, said cylinder block defining a cylinder bore extending therethrough and configured to receive a refrigerant therein, said eccentric positioned in and engaging said cylinder bore whereby rotation of said crankshaft and said eccentric causes reciprocating translation of said cylinder block with respect to said bearing to compress the refrigerant from a suction pressure to a discharge pressure;

said bearing comprising a guide member and said cylinder block comprising a guide recess, said guide member positioned in said guide recess, said guide recess defining relative reciprocating translation of said cylinder block with respect to said bearing; and further comprising a bearing roller, said bearing roller substantially surrounding said guide member.

9. A compressor, comprising:

a hermetic housing including a first portion and a second portion, said housing defining a refrigerant inlet and a refrigerant outlet;

a motor having a stator and rotor, said motor positioned within said housing;

a crankshaft rotatably engaged with said rotor;

a compressor mechanism including a cylinder block mounted within said housing and driven by said crankshaft, said compressor mechanism configured to receive a refrigerant at suction pressure and compress the refrigerant to discharge pressure; and first and second bearings, said crankshaft rotatably supported by at least one of said bearings, said first and second bearings pressed together between said first portion and second portion of said housing, said compressor mechanism mounted to said bearings and said bearings being mounted to said housing by the compression between said first portion and said second portion of said housing;

wherein said cylinder block is spaced radially inwardly from said hermetic housing and said bearings radially enclose and axially support said cylinder block within said hermetic housing.

10. The compressor of claim 9, wherein at least one of said first and second portions of said housing further comprises a recess, at least a portion of at least one of said bearings is received within said recess.

11. The compressor of claim 10, wherein said recess further defines a shoulder, said shoulder substantially entirely contacting said at least one bearing to press said at least one bearing against the other of said first and second portions of said housing.

12. The compressor of claim 9, wherein said bearings are mounted to said housing solely by the compression between said first and second housing portions.

13. The compressor of claim 9, wherein said pressed together bearings form a discharge chamber for compressed refrigerant.

* * * * *